US006286744B1

(12) United States Patent
Crowley

(10) Patent No.: US 6,286,744 B1
(45) Date of Patent: Sep. 11, 2001

(54) STAPLER AND GUIDE ASSEMBLY FOR SAME

(75) Inventor: H. W. Crowley, Eliot, ME (US)

(73) Assignee: Roll Systems, Inc., Burlington, MA (US)

( * ) Notice: Subject to any disclaimer, the term of this patent is extended or adjusted under 35 U.S.C. 154(b) by 50 days.

(21) Appl. No.: 09/694,628

(22) Filed: Oct. 23, 2000

Related U.S. Application Data

(62) Division of application No. 09/179,526, filed on Oct. 27, 1998.

(51) Int. Cl.[7] ..... A41H 37/02

(52) U.S. Cl. ..... 227/69; 227/76; 227/152; 227/155

(58) Field of Search ..... 227/155, 153, 227/152, 151, 154, 76, 69, 64; 29/428, 432.1, 91.4

(56) References Cited

U.S. PATENT DOCUMENTS

| | | | | |
|---|---|---|---|---|
| 218,143 | | 8/1879 | Shellenberger | 227/141 |
| 221,979 | | 11/1879 | Shellenberger | 227/141 |
| 360,178 | | 3/1887 | Snedeker | 227/141 |
| 1,094,588 | | 4/1914 | O'Brien | 227/141 |
| 1,612,870 | | 1/1927 | Leschhorn . | |
| 2,585,807 | | 2/1952 | Mackechnie, Jr. | 1/2 |
| 3,147,485 | * | 9/1964 | Andersen | 227/69 |
| 4,175,314 | | 11/1979 | Spehrley, Jr. | 29/432 |
| 4,220,275 | * | 9/1980 | Hametner et al. | 227/76 |
| 4,378,085 | | 3/1983 | McVeigh | 227/155 |
| 4,546,910 | | 10/1985 | Logtens | 227/155 |
| 4,593,847 | | 6/1986 | Hagemann | 227/155 |
| 4,655,381 | * | 4/1987 | Fontana | 227/155 |
| 4,789,091 | * | 12/1988 | Randolph | 227/76 |
| 4,792,077 | | 12/1988 | Faltin | 227/81 |
| 4,844,319 | | 7/1989 | Kurosawa | 227/79 |
| 5,004,142 | | 4/1991 | Olesen | 227/155 |
| 5,029,745 | | 7/1991 | Akizawa et al. | 227/155 |
| 5,092,829 | * | 3/1992 | Gerber | 227/76 |
| 5,586,710 | | 12/1996 | Golicz | 227/155 |
| 5,976,290 | | 11/1999 | MacDonald et al. | 227/155 |

FOREIGN PATENT DOCUMENTS

| | | | |
|---|---|---|---|
| 4020355 | 1/1992 | (DE) | B42B/4/00 |
| 0009964 | 4/1980 | (EP) | B27F/7/30 |
| 0322906 | 7/1989 | (EP) | B27F/7/23 |
| 2019764 | 11/1979 | (GB) | B27F/7/08 |
| 2024083 | 1/1980 | (GB) | B27F/7/08 |
| WO90/08015 | 7/1990 | (WO) | B25C/7/00 |

OTHER PUBLICATIONS

Spehrley, Jr., Charles J., Xerox Disclosure Journal, "Semi–Active Clincher," vol. 8, No. 3, May/Jun. 1983, pp. 187–188.

Cited as category A Technological Background in a European Search Report related to U.S. Patent No. 5.586,710.

* cited by examiner

*Primary Examiner*—Scott A. Smith
(74) *Attorney, Agent, or Firm*—William A. Loginov; Cesari and McKenna, LLP

(57) ABSTRACT

The invention is a stapler and staple guide assembly for same. The stapler provides automated stapling for stacks of sheet material regardless of stack thickness. In a first embodiment two staple guides load individual sheets or small stacks of sheets onto a staple with the staple supported in a base. The staple is then cut to an appropriate height and cinched. In another embodiment, numerous split guides may be cascaded to increase staple loading speed. Other improvements to a stapling process include dimpling sheets of material and/or pre-drilling sheets of material to simplify loading sheets onto a staple.

6 Claims, 10 Drawing Sheets

STAPLER AND GUIDE ASSEMBLY FOR SAME

RELATED APPLICATION

This is a divisional of co-pending U.S. patent application Ser. No. 09/179,526 filed Oct. 27, 1998.

FIELD OF INVENTION

This invention relates to stapling sheets of material such as paper. More particularly, this invention relates to an improved stapler using staple guides.

BACKGROUND OF THE INVENTION

In a conventional stapler or stitcher, a pre-formed staple, or wire concurrently formed into a U-shape, is provided. Two staple prongs defining the U-shape are driven through a stack of paper and into an opposing surface. The opposing surface and a staple driving surface compress the stack of paper while the staple prongs are driven into the stack. Once the prongs have pierced the paper to contact the opposing surface, channels in the opposing surface operate to fold the staple prongs, thus securely cinching the stack of paper. In such a stapler, the length of the prongs limits the thickness of the paper stack that can be so secured. If the stack is too thick, the prongs will not extend sufficiently through the paper to firmly cinch the stack. If the stack is too thin, the excessively long prongs will meet the channels of the opposing surface and fold without contacting the associated surface of the stack. The resulting staple will only loosely bind the sheets of paper, leading to chaffing and tearing of the stapled stack of sheets. Thus a disadvantage of conventional staplers is that varied stapling applications require different length staples, and often different staplers.

A further disadvantage to these staplers, particularly those designed for relatively thick stacks of paper, is that each staple prong must have sufficient axial rigidity to pierce the complete stack, regardless of the strength required to permanently bind the stapled stack. Further, in order to pierce thicker stacks of material, each staple must have a sharpened, or "chisel" point to ensure good piercing. Where a concurrently formed wire is used, forming a sharpened point may not be practical. Thus additional design constraints are placed upon the staples which have no bearing on the strength of the final attachment.

Accordingly, it is an object of the invention to provide a stapler which can operate on stacks of sheet material having widely varied thicknesses without any compromise in the strength of the stapled attachment. It is further desired that the invention operate with any staple adequate to maintain the final attachment, without the need for the axial strength and sharpness required by customary staples to pierce sheets of material.

SUMMARY OF THE INVENTION

To accomplish the foregoing and other objects, features, and advantages of the invention there is provided a stapler for attaching sheets of material. The invention can operate with any type of staple, and further will provide a secure attachment regardless of the thickness of a stack of materials being stapled.

In the preferred embodiment, the stapler includes a base for securing a staple, a staple guide, a ram for driving the staple firmly into a stack of sheet material, a clamp for maintaining pressure against the ram during the ramming operation, a staple cutter for cutting the staple to a desired length once the stack of material is clamped, and a staple cincher for folding the cut ends of the staple into a secure position.

In one embodiment, the staple guide comprises a pair of cylindrical shells, one shell impaling a sheet of material on each prong of the staple. In another embodiment, the staple guide comprises a split guide which can open for horizontal removal from the staple prongs. In this embodiment, several staple guides may be operated in a cascading fashion to speed the process of loading a staple with sheets of material. In another embodiment, the staple guide may be omitted in favor of pre-drilled holes which are aligned with the staple prongs.

The stapler can also include a dimpler which places dimples in sheets of material to assist in the proper alignment of the staple prongs while they pierce each sheet.

BRIEF DESCRIPTION OF THE DRAWINGS

The invention description below refers to the accompanying drawings, of which.

DETAILED DESCRIPTION OF AN ILLUSTRATIVE EMBODIMENT

The stapler of the present invention can be used with any sheet material. One feature of the stapler relates to the ability to fasten stacks of sheet material having arbitrary thickness. As a further advantage, the stapler permits fastening without the use of specialized staples. The foregoing discussion relates to sheets of material. It should be readily apparent that the sheets may be paper, plastic, metal, cloth, or other sheet material which is suitable for fastening into a stack of sheets. Thus the use of the term "sheet" should be taken to include any such sheet material according to this invention.

Figure 1:
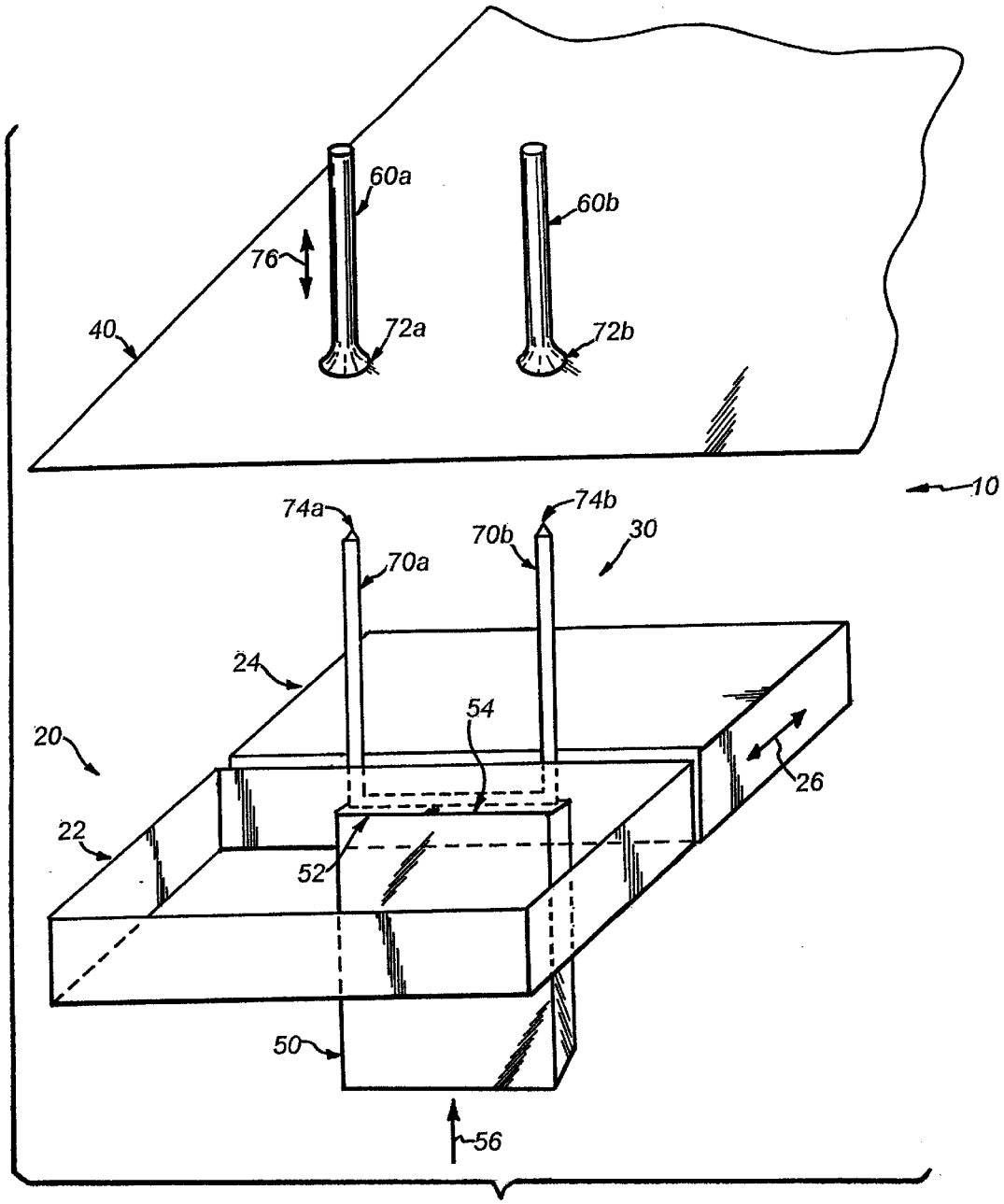
FIG. 1 is a perspective view of the stapler and staple guides.

The stapler 10 of the present invention is shown in FIG. 1. The stapler 10 includes a base 20, which can be any stable surface. In this embodiment, the base 20 includes a fixed portion 22 and a movable portion 24. The movable portion 24 can move according to the bi-directional arrow 26 to clamp and unclamp a staple 30. It should be appreciated that the use of a number of well-known clamping systems is contemplated, and that the base 20 may include any such system, including a clamp, vise, clasp, brace, or other system, and may be actuated by any mechanical, electrical, electromechanical, or pneumatic system, provided it can support the staple 30 with sufficient gripping strength to permit impalement of a sheet or sheets 40 thereon.

Figure 7:
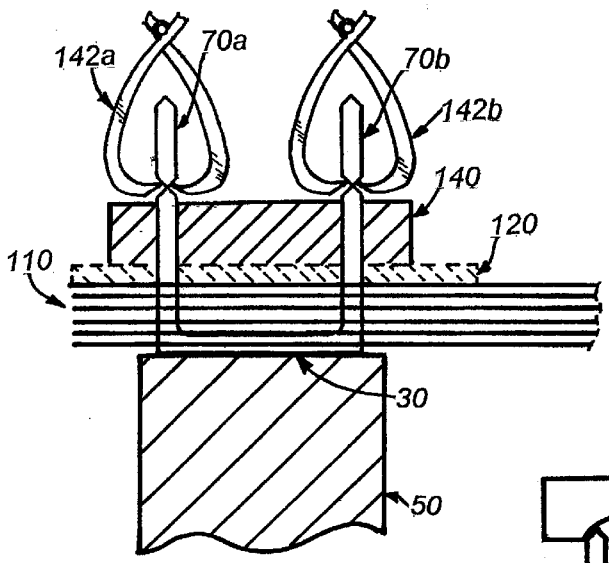
FIG. 7 is a side view of a staple cutter and jig.
Figure 8:
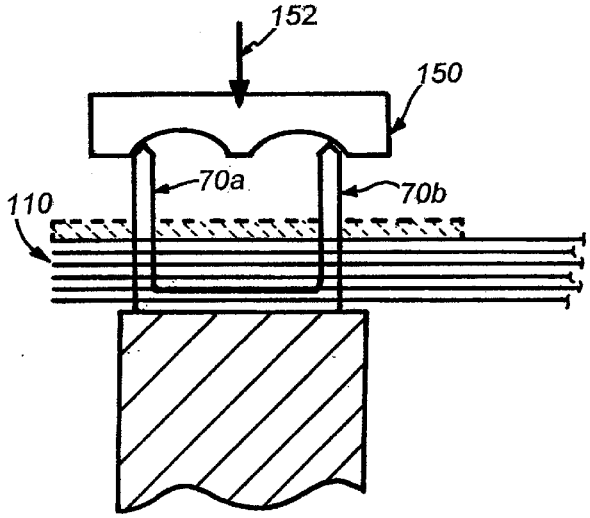
FIG. 8 is a side view showing of the staple cincher.
Figure 9:
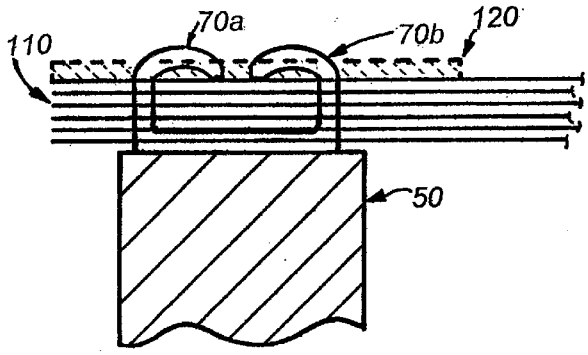
FIG. 9 is a side view showing a cinched staple.

The base 20 is further configured to permit a ram 50 to pass through the bottom thereof. The ram 50 has an upper surface 52, which engages a lower surface 54 of the staple 30. The ram 50 provides upward thrust in the direction of the arrow 56 once a stack of sheets (not shown) is ready for stapling, which is described in greater detail below. Any ramming apparatus may be used, such as a hammer or piston, and the ram 50 may be actuated by any mechanical, electrical, electromechanical, or pneumatic system, provided the ram can provide sufficient driving force to drive a staple 30 into a stack of sheets (not shown) such that the staple 30 is approximately flush with the stack of sheets. It is specifically contemplated that the ram 50 will be actuated after a stack of sheets is assembled onto the staple 30, and will move upward until the upper surface 52 of the ram 50 is flush with the base 20, as shown in FIGS. 7–9 below. The lower surface 54 of the staple 30 and the upper surface 52 of the ram 50 may optionally be configured so that they closely mate with one another.

Two staple guides 60*a* and 60*b* are positioned on top of the sheet 40 and aligned with two prongs 70*a* and 70*b* of the staple 30. The staple guides 60*a* and 60*b* are of a hollow cylindrical construction and may be made of any rigid material. Each staple guide 60*a*, 60*b* may have a flared lower opening 72*a*, 72*b* which improves the alignment of the sheet 40 and the staple guides 60*a* and 60*b* with the prongs 70*a* and 70*b* of the staple 30. The staple guides 60*a* and 60*b* are vertically movable along the bi-direction arrow 76. The motion of the staple guides 60*a* and 60*b* may be controlled by any mechanical, electrical, electro-mechanical, or pneumatic system, provided the system can deliver sufficient force to impale the sheet 40 on the two prongs 70*a* and 70*b* of the staple 30.

Each staple 30 further has a free end 74*a* and 74*b* on each prong 70*a* and 70*b*. Each free end 74*a*, 74*b* will typically be "chisel-cut" with a sharp point which will more easily pierce the sheet 40. However, the free end 74*a*, 74*b* may also be a flat, wire-cutter sliced end or other end produced by known cutting techniques, provided it does not impair the impalement of the associated prong 70*a*, 70*b* on the sheet 40.

Figure 2:
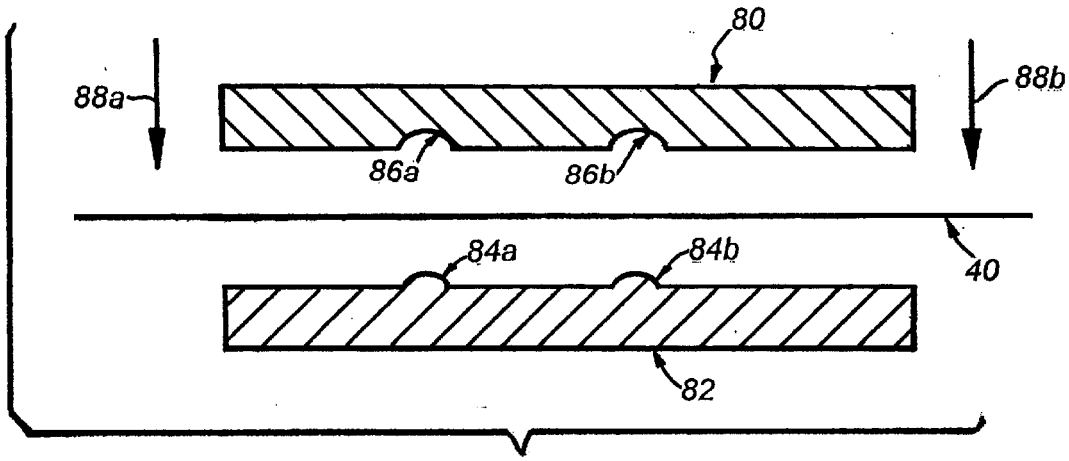
FIGS. 2–4 are side views of a dimpling process using a dimpler.
Figure 3:
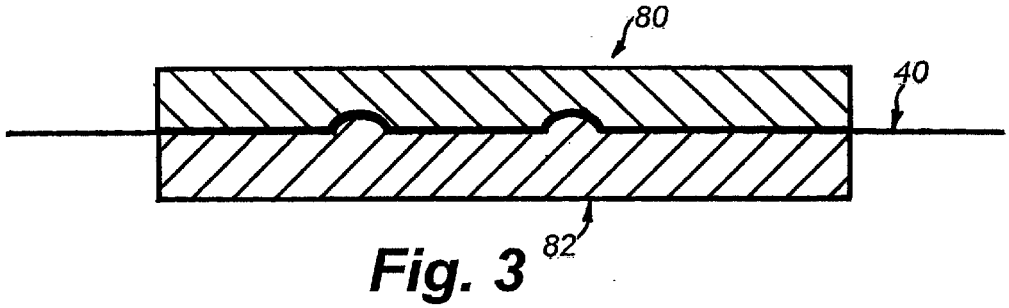
Figure 4:
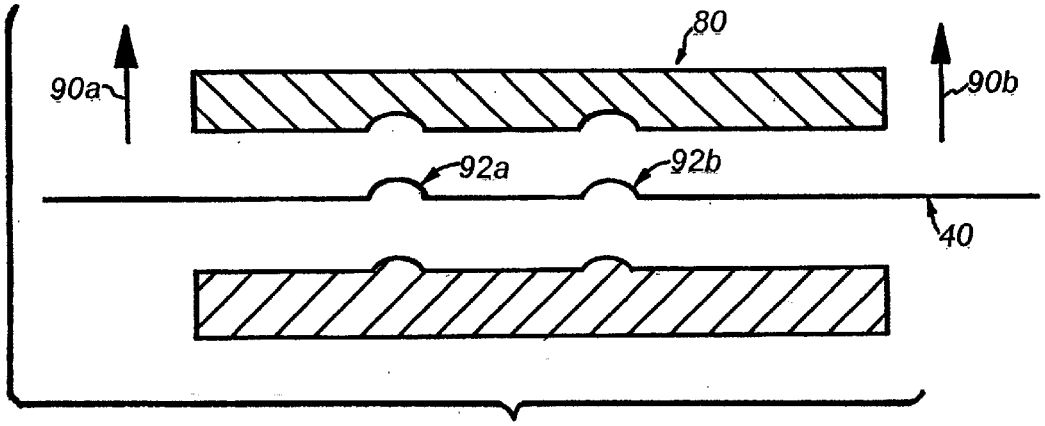

The operation of the stapler 10 is now described in detail. Referring first to FIGS. 2–4, an embodiment of the stapler 10 can optionally include a dimpler for pre-forming each sheet 40. Dimples on the pre-formed sheets will tend to align the prongs 70*a* and 70*b* of the staple 30 during the staple loading procedure. As shown in FIG. 2, a sheet 40 is position between a top template 80 and a bottom template 82. The bottom template 82 includes two protrusions 84*a* and 84*b* for impressing a dimple onto the sheet 40. The top template 80 includes two indents 86*a* and 86*b* which match the two protrusions 84*a* and 84*b* of the bottom template 82. The protrusions 84*a* and 84*b* must be sufficiently rigid to impress a dimple on the sheet 40. The sheet 40 may be aligned using any well-known methods such as edge guides, and may be moved into position using a vacuum, a directed stream of air, tractor feeds, wheels, vibration, or any other mechanical, electrical, electromechanical, or pneumatic system. Once the sheet 40 is aligned, the top template 80 is lowered onto the bottom template 82 in the direction of the arrows 88*a* and 88*b*. It should be appreciated that the bottom template 82 may instead be raised toward the top template 80, or that the bottom template 82 and the top template 80 may both move toward the sheet 40.

As shown in FIG. 3, the top template 80 contacts the sheet 40 and presses the sheet into the bottom template 82, thereby conforming the sheet 40 to the top template 80 and the bottom template 82. Referring now to FIG. 4, the top template 80 is raised in the direction of the arrows 90*a* and 90*b* to release the sheet 40. The mating of the top template 80 and the bottom template 82 leaves dimples 92*a* and 92*b* impressed on the sheet 40. It should be appreciated that the several sheets 40 may be arranged in an aligned stack (not shown) and dimpled at the same time. In this case, each protrusion 84*a*, 84*b* must be sufficiently rigid to impress a dimple on each sheet of the aligned stack of sheets.

Figure 5:
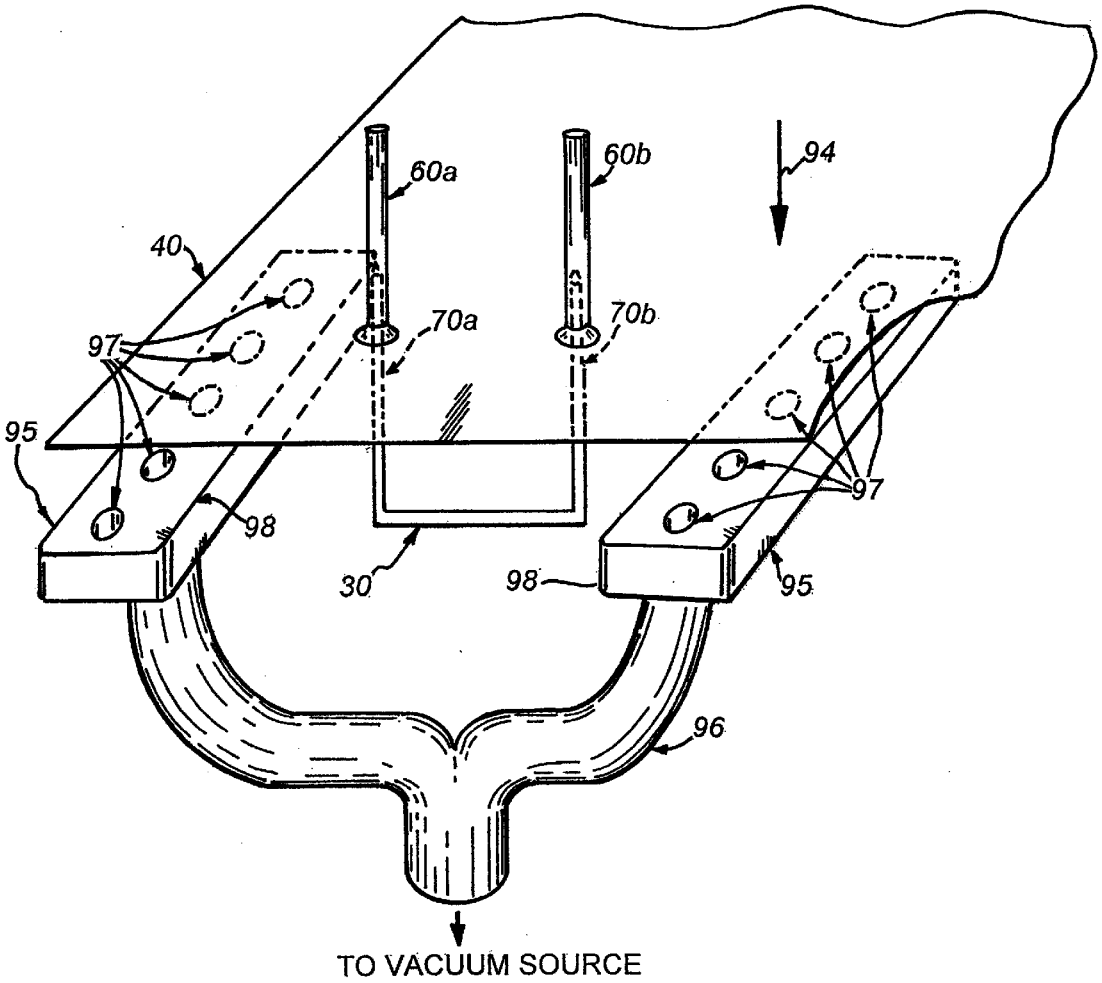
FIG. 5 is a perspective view showing the loading of a sheet of material onto a staple using the staple guides.

Referring now to FIG. 5, the use of the staple guides 60*a* and 60*b* is shown. As previously described, a staple 30 is supported in the base 20 (FIG. 1). With the sheet 40 properly aligned over the staple 30, the staple guides 60*a* and 60*b* are directed downward as shown by the arrow 94. The downward motion of the staple guides 60*a* and 60*b* drives the sheet 40 onto the prongs 70*a* and 70*b* of the staple 30, thus impaling the sheet 40 on the prongs 70*a* and 70*b*. The downward motion of the staple guides 60*a* and 60*b* continue until the sheet 40 contacts the base 20 (FIG. 1). The staple guides 60*a* and 60*b* are then lifted, a second sheet (not shown) is aligned, and the downward motion along the arrow 94 is repeated until the second sheet contacts the first sheet 40. This procedure may be repeated as frequently as desired, provided the thickness of the resulting stack of sheets does not exceed the length of the prongs 70*a* and 70*b* of the staple 30. It should also be appreciated that more than one sheet may be impaled at a single time. Small stacks of two or more sheets may be aligned and impaled in groups, provided the stack is not so thick that it impairs the downward motion of the staple guides 60*a* and 60*b*.

A vacuum source may also be used to draw the sheet 40 downward. In an embodiment using a vacuum source, the vacuum source is connected to one or more plates 95 by tubing 96. Holes 97 in an upper surface 98 of the plates 95 provide the vacuum source at the upper surface 98, thus making the upper surface 98 a gripping surface for gripping sheets of material. When the plates 95 are contacted to a sheet 40, a vacuum seal is formed between the plates 95 and the sheet 40. The plates 95 may then be moved, drawing the sheet 40 with them. The vacuum source may then be normalized or reversed to release the sheet 40.

Figure 6:
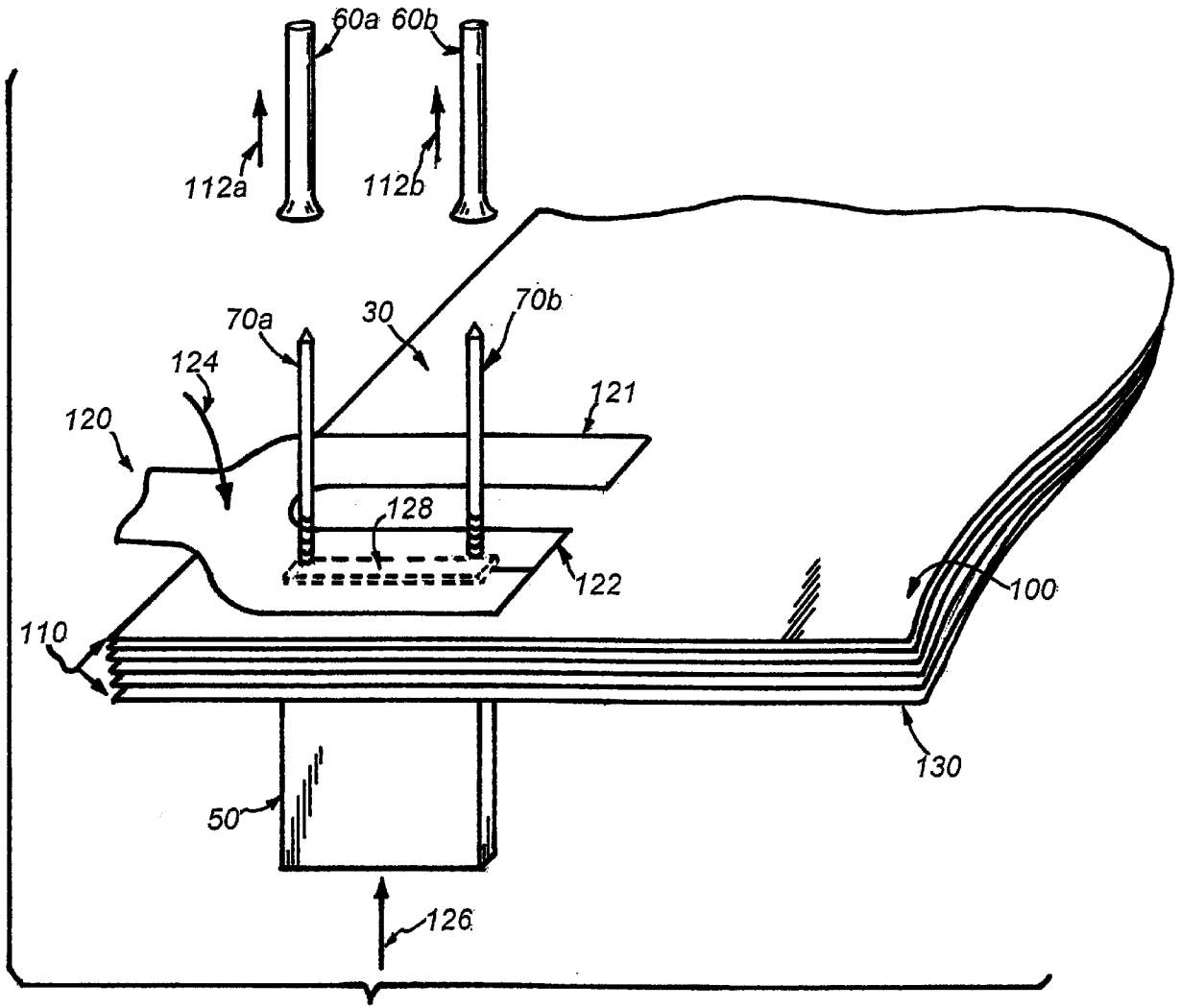
FIG. 6 is a perspective view showing the clamping of a stack and ramming of a staple.

As shown in FIG. 6, after a top sheet 100 has been added to a stack 110, the staple guides 60*a* and 60*b* are again raised from the prongs 70*a* and 70*b* of the staple 30 in the direction of the arrows 112*a* and 112*b*. A clamp 120 is then employed to compress the stack 110 against the base 20 (not shown). This ensures that the resulting stapled stack is tightly secured. The clamp 120 is preferably lowered onto the stack of sheets from above in order to avoid chaffing the top sheet 100. In this embodiment, two U-shaped fingers 121 and 122 accommodate the prongs 70*a* and 70*b*, which are still protruding from the stack 110, and the clamp 120 is rotated down onto the stack as shown by the arrow 124. A number of other configurations for the clamp 120 are possible, and the clamp may be activated by any suitable electrical, mechanical, electromechanical, or pneumatic system, provided the system can accommodate stacks of varying thickness. With the stack 110 clamped in position, the movable portion 24 (FIG. 1) of the base 20 (FIG. 1) is moved slightly away from the staple 30 to release the staple 30 from the base 20. At the same time, the ram 50 is driven upward as indicated by the arrow 126 so that a binding surface 128 of the staple 30 engages the bottom sheet 130. At this point the stack of sheets 110 is firmly compressed between the binding surface 124 of the staple 30 and the clamp 120.

As shown in FIGS. 7–9, the staple 30 must be cinched after it is clamped and rammed. In order to cinch the staple 30, the prongs 70*a* and 70*b* must first be cut to the correct size. If the thickness of the stack 110 and the length of the prongs 70*a* and 70*b* are already known, it may be possible to omit this cutting step. With the stack 110 firmly secured between the ram 50 (and the staple 30, where the ram 50 contacts the staple 30) and the clamp 120, a jig 140 is lowered onto the stack 110 to define the correct length of the prongs 70*a* and 70*b*. A pincer 142*a*, 142*b* is lowered over each prong 70*a*, 70*b* until it is adjacent to the jig 140. At this point, each pincer 142*a*, 142*b* is closed to cut each prong 70*a*, 70*b* to the correct height.

In FIG. 8, a cincher 150 is lowered onto the cut prongs 70*a* and 70*b* in the direction of the arrow 152. The cincher 150 is designed to direct the prongs 70*a* and 70*b* inward and down, thus pressing the prongs 70*a* and 70*b* into the stack 110. FIG. 9 shows the folded prongs 70*a* and 70*b*. Once the prongs 70*a* and 70*b* have been folded, the clamp 120 and the ram 50 may be withdrawn from the stack 110 and the stapling operating is complete. It should be appreciated that many systems are known for cutting staples, as are numerous means for gauging the correct prong height and cinching the cut prongs. Any electrical, mechanical, electromechanical, or pneumatic means may be used. for these tasks, provided they result in a securely stapled stack of sheets. Additionally, variations of the cinching operation are possible, such as fixing the cincher flush with the sheets and using the ram 50 to drive the staple 30 into the cincher 150, or simultaneously moving the cincher 150 and the ram 50 toward each other. Any such configuration may be used, provided it results in a firmly secured stack 110.

Figure 10:
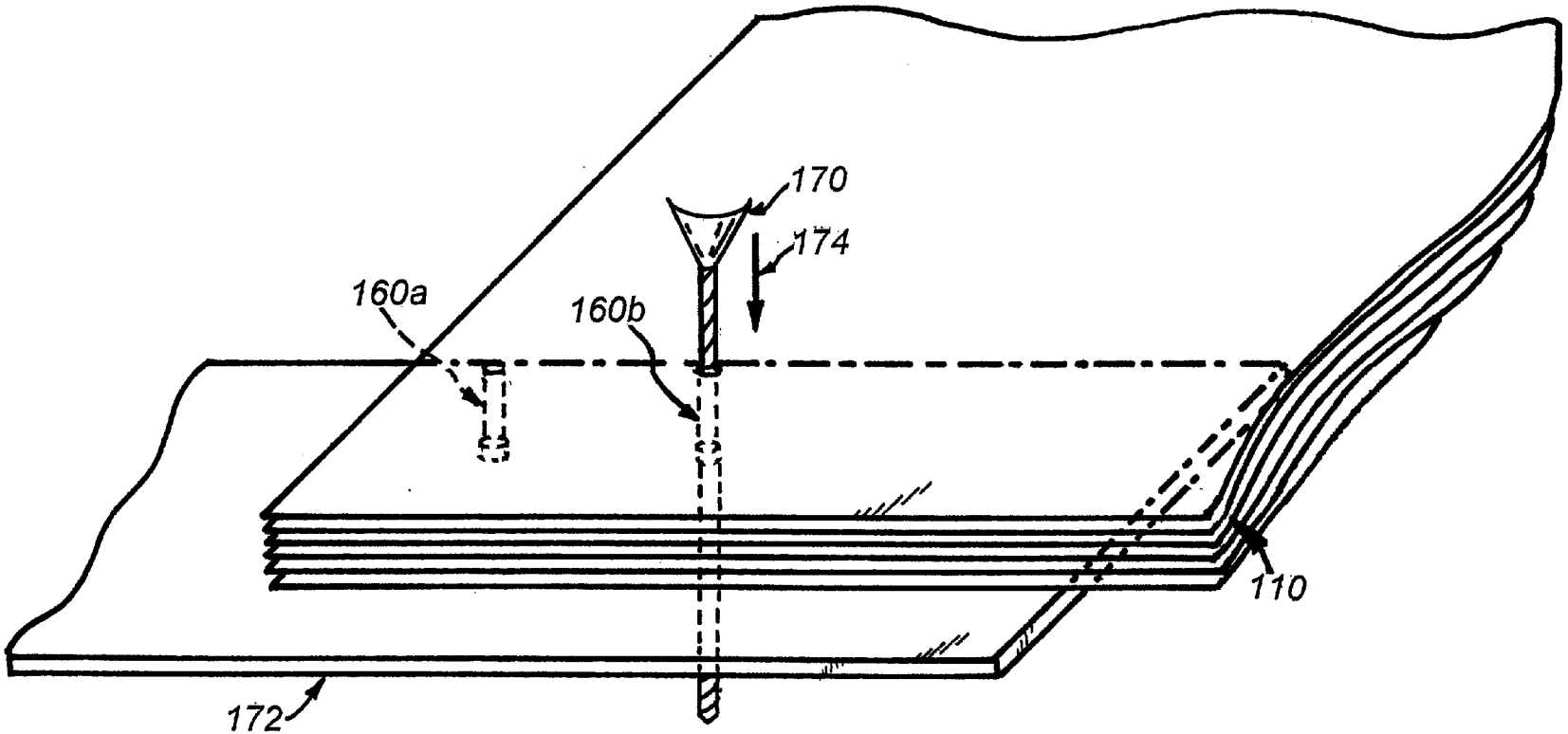
FIG. 10 is a perspective view of a drilling operation.

FIG. 10 shows another embodiment of the invention. In this embodiment, the stack 110 is pre-drilled with holes 160*a* and 160*b* using a drill 170. Instead of the drill 170, a hole punch may be used. A supporting base 172 is provided to receive the downward pressure of the drill 170 when the drill 170 is directed downward along the arrow 174. In this embodiment, the drill holes 160*a* and 160*b* should be appropriately sized to accommodate stacking onto a staple (not shown) without the need for a staple guide. The stack 110 may then be directly loaded onto a staple and cinched according to the procedure described with reference to FIGS. 7–9.

Figure 11:
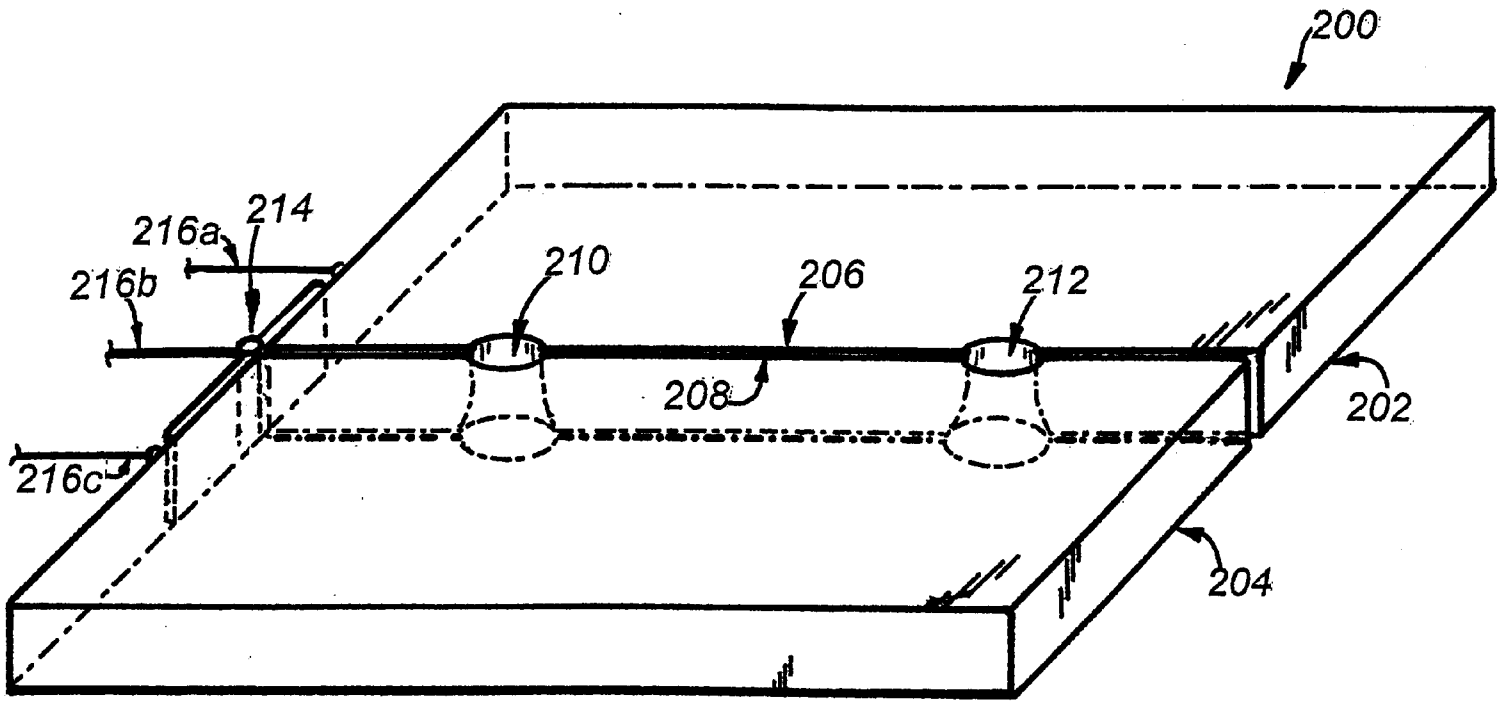
FIG. 11 is a perspective view of a split staple guide of the present invention.
Figure 12:
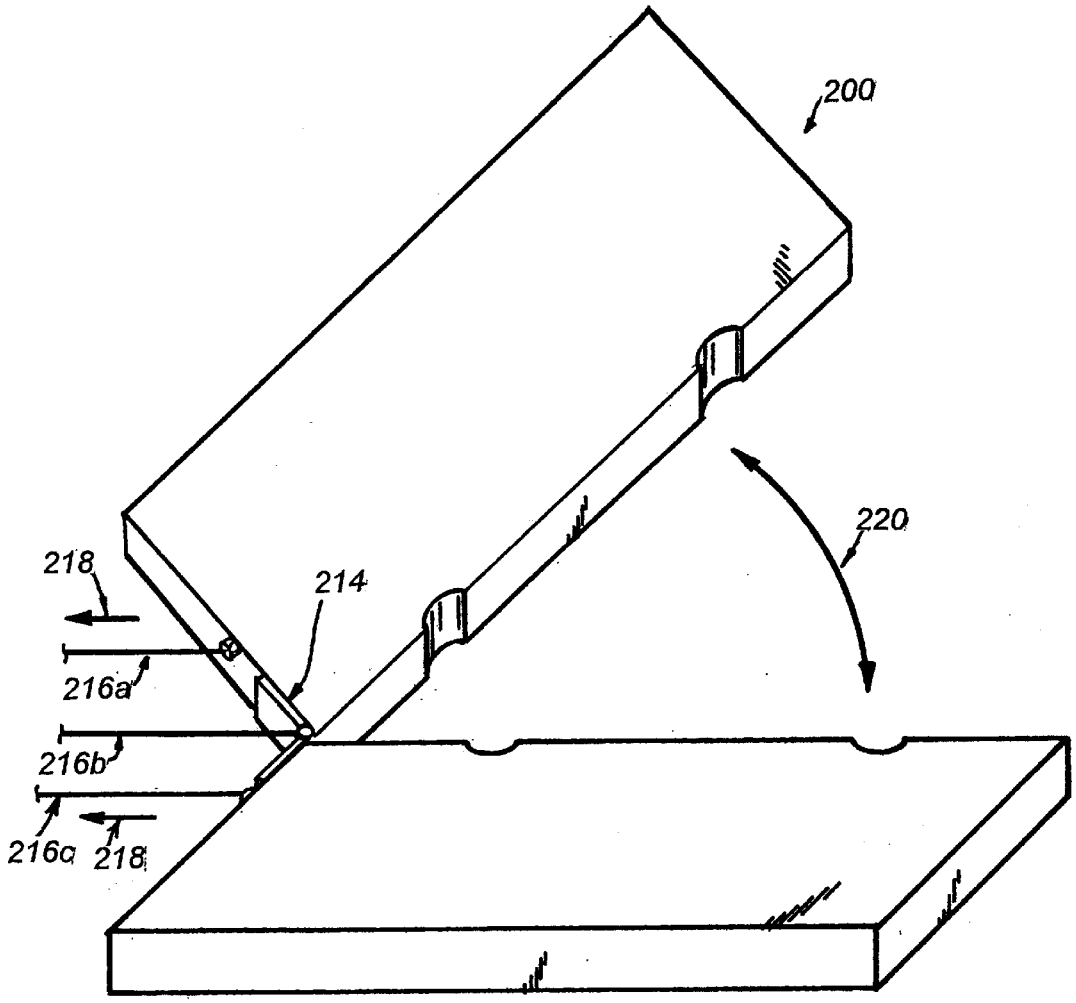
FIG. 12 is a perspective view of the split staple guide in an open position.

FIG. 11 shows a different embodiment for a staple guide 200. In this embodiment, the staple guide 200 is a split staple guide comprising a first piece 202 and a second piece 204. Each piece 202, 204 has an inner surface 206, 208, and when the inner surfaces 206 and 208 are abutting, they define two guide holes 210 and 212. The two pieces 202 and 204 are pivotally joined by a hinge 214 on one end, and the hinge 214 can be actuated using control rods 216*a*, 216*b*, and 216*c*. As shown in FIG. 12, the control rods 216 can operate to open the hinge 214 by withdrawing rods 216*a* and 216*c* along the arrows 218. This produces a hinging action where the first piece 202 pivots away from the second piece 204, as indicated by the bidirectional arrow 220. In this open position, the staple guide 200 may be withdrawn from a stack (not shown) in the horizontal plane, without any need to raise the staple guide 200 above the prongs of a staple (not shown).

Figure 13:
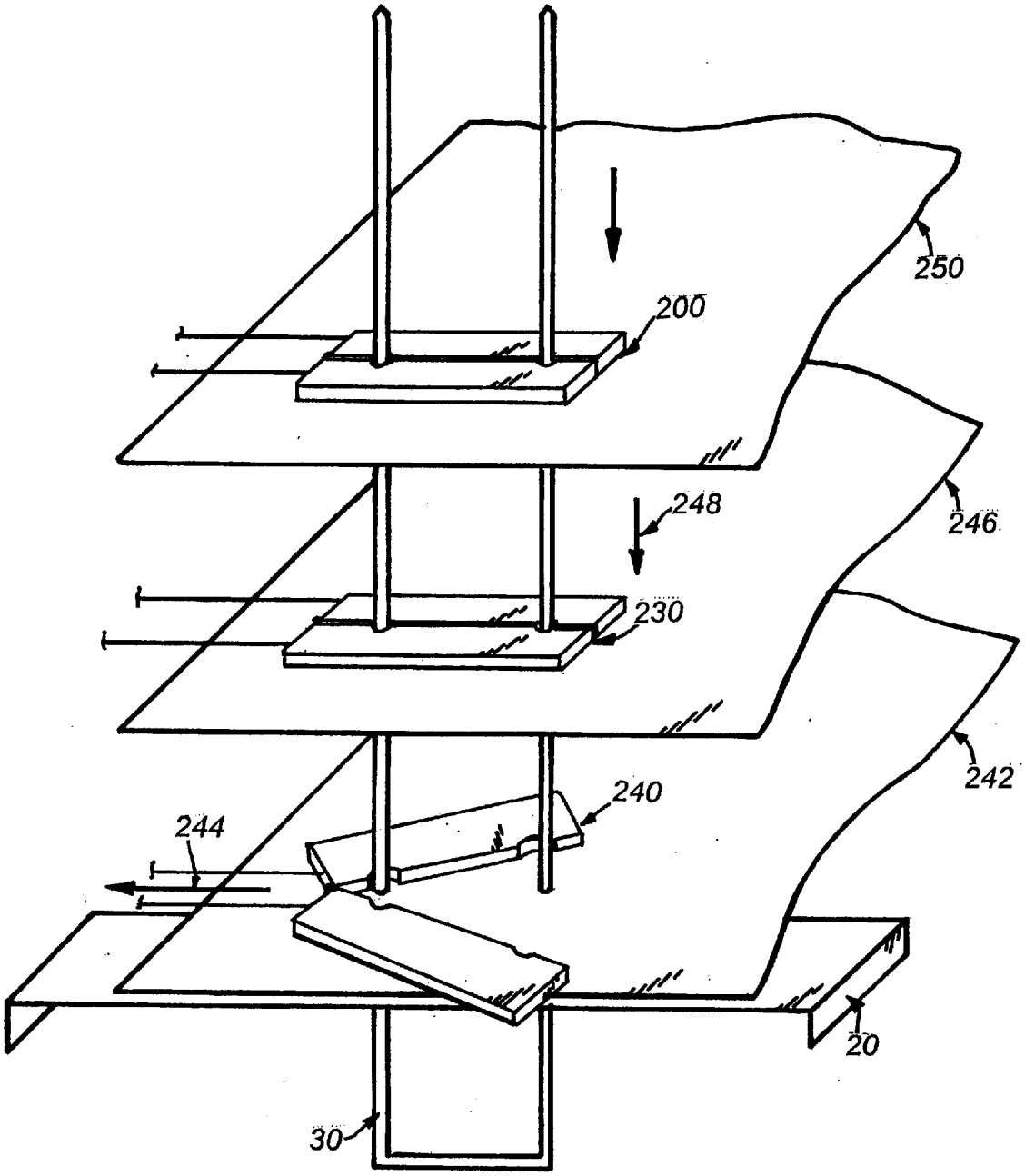
FIG. 13 is a perspective view of a plurality of cascaded split guides.

Referring now to FIG. 13, the split staple guide 200 can be seen in a staple loading operation, in conjunction with additional split guides 230 and 240. The lowest staple guide 240 has lowered a sheet 242 down to the base 20 of the stapler 10. The staple guide 240 is then opened and withdrawn horizontally as indicated by the arrow 244. At the same time, a second sheet 246 is being lowered onto the staple 30 using another staple guide 230, which draws the second sheet 246 down the staple 30 as indicated by the arrow 248. Another sheet 250 is simultaneously being drawn down the staple 30 by the top staple guide 200. Any number of sheets may be accommodated by this approach. Once the bottom staple guide 240 is withdrawn horizontally, it can be returned to the top of the staple 30 and positioned to impale and load an additional sheet. This cascading technique can be used to speed the staple loading operation where a guide is needed for each one or small group of sheets.

Figure 14:
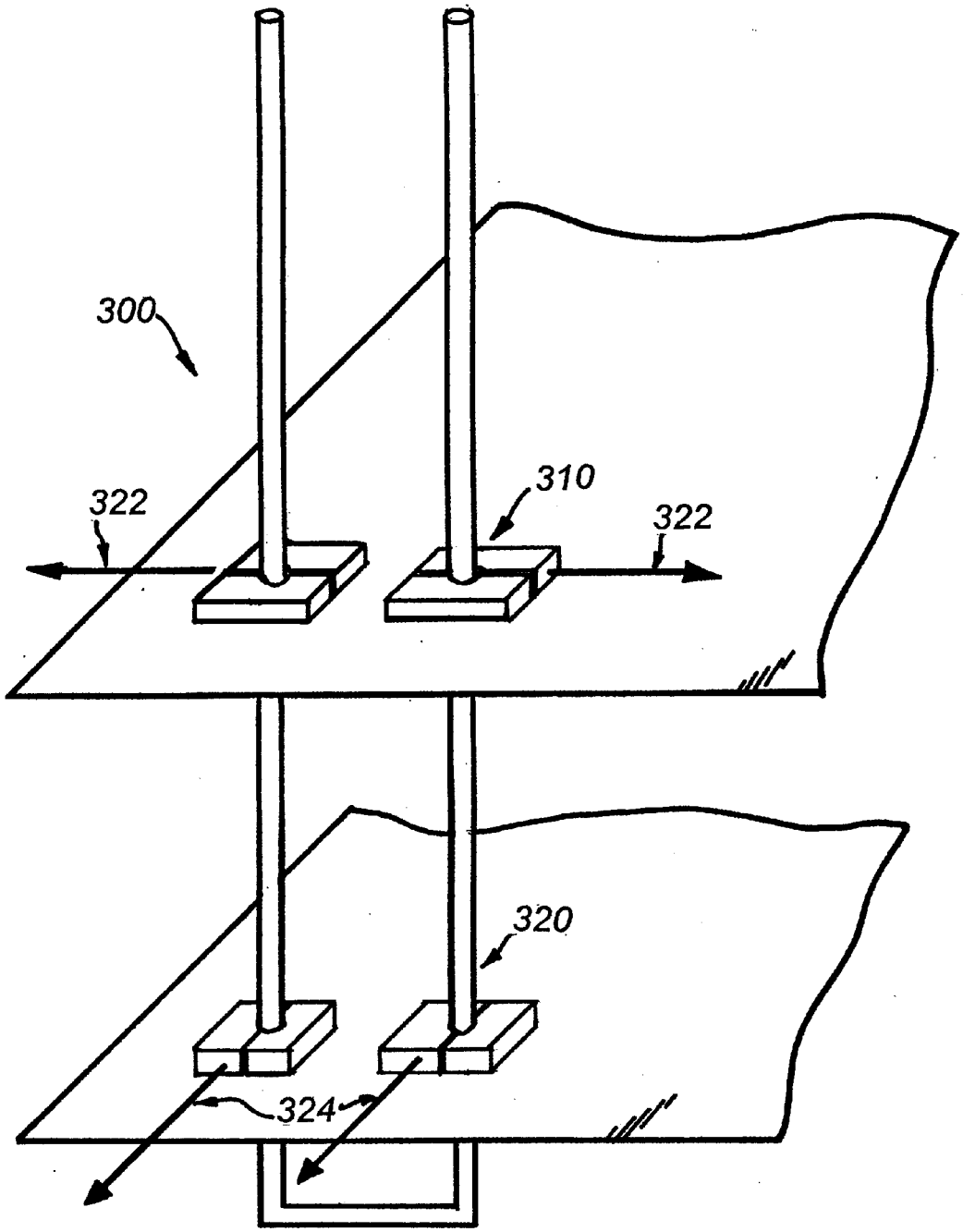
FIG. 14 is a perspective view of a preferred embodiment using orthogonal, cascaded split guides.

FIG. 14 shows a preferred embodiment of the split staple guide 300. In this embodiment, two pairs of split staple guides 310 and 320 are provided. The first pair of split guides 310 is inserted and withdrawn in a motion orthogonal to the second split pair of staple guides 320, as shown by the arrows 322 (indicating the direction of the first pair of split guides 310) and 324 (indicating the direction of the second pair of split guides 320). This arrangement advantageously provides more space for any split guide actuators, simplifing construction and operation of the guides.

Having now described various embodiments of the present invention along with certain variations thereof, it should be apparent to those skilled in the art that other modifications and other embodiments will also fall within the scope of the present invention as defined by the following claims. For example, the staple cincher 150 may be a pair of levers pushing on a staple 30 from the sides to fold the prongs 70*a* and 70*b*, the actuating rods 216 of the split guide 200 may instead be a small servo or other actuator mounted directly on the staple guide 200 for remote activation, and the jig 140 for measuring the length of prongs 70*a* and 70*b* may be instead and infrared or ultrasound distance sensor connected to a control unit for positioning the pincers 142. A number of other elements of the invention have well-known substitutes. Accordingly, the above description is meant to be taken by way of example and not to otherwise limit the scope of this invention.

What is claimed is:

1. A stapler for attaching a plurality of sheets of material using a staple, the staple having two prongs, each prong having a free end, the stapler comprising:

a base for supporting the staple in a fixed position, the base having a first piece and a second piece, at least one of the first piece and the second piece being movable to secure and release the staple;

a drill for producing two holes in a stack of material, each hole being aligned with one of the prongs of the staple;

a clamp for compressing a stack of material onto the staple;

a ram for driving the staple into the stack of material;

a staple cutter for cutting the free end of each one of the prongs at a predetermined height above the stack of material; and a staple cincher for folding the free end of each one of the prongs onto the stack of material.

2. A stapler for attaching a plurality of sheets of material using a staple, the staple having two prongs, each prong having a free end, the stapler comprising:

a base comprising a first piece and a second piece wherein at least one of the first piece and the second piece are movable to alternately secure and release the staple such that individual sheets of material or individual groupings of a plurality of sheets of material may be individually pressed onto the staple prongs while the staple is held firmly in place in the base; and a drill for producing two holes in a stack of material, each hole being aligned with one of the prongs of the staple.

3. The stapler of claim 2 further comprisng a clamp for compressing a stack of material onto the staple.

4. The stapler of claim 2 further comprisng a ram for driving the staple into the stack of material.

5. The stapler of claim 2 further comprisng a staple cutter for cutting the free end of each one of the prongs at a predetermined height above the stack of material.

6. The stapler of claim 2 further comprisng a staple cincher for folding the free end of each one of the prongs onto the stack of material.

* * * * *